United States Patent [19]

Valenti

[11] Patent Number: 4,607,750

[45] Date of Patent: Aug. 26, 1986

[54] CONTAINER FOR RECEIVING VARIOUS ARTICLES, IN PARTICULAR CYLINDRICAL ARTICLES

[75] Inventor: Dante Valenti, Imola, Italy

[73] Assignee: IN-PAK s.r.l., Imola, Italy

[21] Appl. No.: 706,172

[22] Filed: Feb. 27, 1985

[30] Foreign Application Priority Data

Mar. 6, 1984 [IT] Italy ..... 4803/84[U]

[51] Int. Cl.[4] ..... B65D 85/20

[52] U.S. Cl. ..... 206/443; 206/427; 206/446; 206/587; 229/168; 229/172

[58] Field of Search ..... 206/427, 429, 432, 433, 206/443, 446, 564, 587; 229/27, 31 R, 31 FS, 34 A, 34 B, 34 R

[56] References Cited

U.S. PATENT DOCUMENTS

| | | | |
|---|---|---|---|
| 3,481,453 | 12/1969 | Shreve, III et al. . | |
| 3,552,633 | 1/1971 | Ketler | 229/44 R |
| 3,990,624 | 11/1976 | Melli | 206/433 |
| 4,067,442 | 1/1978 | Howe | 206/433 |

FOREIGN PATENT DOCUMENTS

| | | | |
|---|---|---|---|
| 1150134 | 1/1958 | France . | |
| 0072757 | 4/1960 | France | 229/34 R |
| 2267246 | 11/1975 | France . | |
| 2482562 | 11/1981 | France . | |
| 2488568 | 2/1982 | France | 229/34 R |
| 8204276 | 6/1983 | Netherlands | 229/31 R |
| 0298846 | 10/1928 | United Kingdom | 229/34 R |
| 2081225 | 2/1982 | United Kingdom | 229/31 R |

*Primary Examiner*—William Price
*Assistant Examiner*—Jimmy G. Foster
*Attorney, Agent, or Firm*—Stevens, Davis, Miller & Mosher

[57] ABSTRACT

The container is formed out of a blank and possesses considerable mechanical strength as a consequence of the thickness of the sides being doubled through first parts, the thickness of the bottom being doubled through second parts, the ends offering notable resistance to flattening due to the presence of strengthening edges, the thickness of the said ends being doubled in the region of the corresponding central areas and, lastly, the end pieces of the sides being locked to the strengthening edges of the said ends.

5 Claims, 4 Drawing Figures

CONTAINER FOR RECEIVING VARIOUS ARTICLES, IN PARTICULAR CYLINDRICAL ARTICLES

BACKGROUND OF THE INVENTION

The invention relates to an improved container for receiving various articles, in particular cylindrical articles.

DESCRIPTION OF THE PRIOR ART

It is a known fact that to be able to stack containers at a height corresponding to that of the storage area itself has a beneficial effect in bringing down warehouse stacking costs, as does also the possibility of handling (for example to move from one place to another) a stack of containers without danger of the said stack coming to pieces.

Although the foregoing statements are based on the presupposition that the mechanical strength of the containers be adequate, particularly in the face of torsion or flattening, the necessary quality is not possessed by known containers marketed at the present time.

SUMMARY OF THE INVENTION

The object of the invention is, therefore, to make available a container of the type that can be, formed out of one single blank into a configuration such as to define, in the inside thereof, housings for the cylindrical articles at the ends of the rows of articles received therein, as well as such as to be of a greater mechanical strength than is the case with known containers, achieving all this through an original technical solution that also allows the said articles to be seen, yet does not render necessary the use of sophisticated equipment for the automatic realization of the said container.

This object is achieved with the improved container according to the invention for receiving various articles, in particular cylindrical articles, of the type formed out of one single blank in which there are crosswise slits, as well as longitudinal and transverse lines of articulation defining the bottom, the sides and the ends, respectively, of the container, characterized by the fact that to each vertical edge of the said ends is articulated a limb, of a height corrresponding to that of the said ends, that is folded, in the region of vertical articulations, towards the inside face of each end so as to define, in the order stated, a first strengthening edge, a central area destined to be glued to the said inside face and, lastly, a terminal zone, with the said first edge comprising a vertical strip parallel to and inside the corresponding side; characterized by the fact that to the upper transverse edge of each end is articulated a corresponding element, constituted by a central section, placed resting on the upper extremities of the pair of limbs attached to the said end, as well as by two extremity sections that can be turned downwards in close contact with the corresponding vertical strips of the said edges in order to be glued to the said strips; characterized by the fact that each side is provided with two end pieces placed in close contact with the corresponding vertical strips of the said edges in order to be glued to these underneath the extremity sections of the corresponding elements; to each side being centrally articulated, in the region of the upper edge, a corresponding area constituted by a first part, placed in close contact with the inside face of the said side, as well as by a second part, articulated longitudinally to the first part, placed in close contact with the said bottom in order to be glued thereto.

For the purpose of increasing still further the mechanical strength of the ends of the container, the terminal zone of each limb is folded, in the region of vertical articulations, so as to define a second vertical, tubular, strengthening edge as well as an end strip destined to be glued to the inside face of the end concerned.

BRIEF DESCRIPTION OF THE DRAWINGS

Characteristics of the invention that may not be apparent from what has been stated above are emphasized in the text that follows, with reference to the accompanying tables of drawings, in which.

DESCRIPTION OF THE PREFERRED EMBODIMENT

Figure 1:
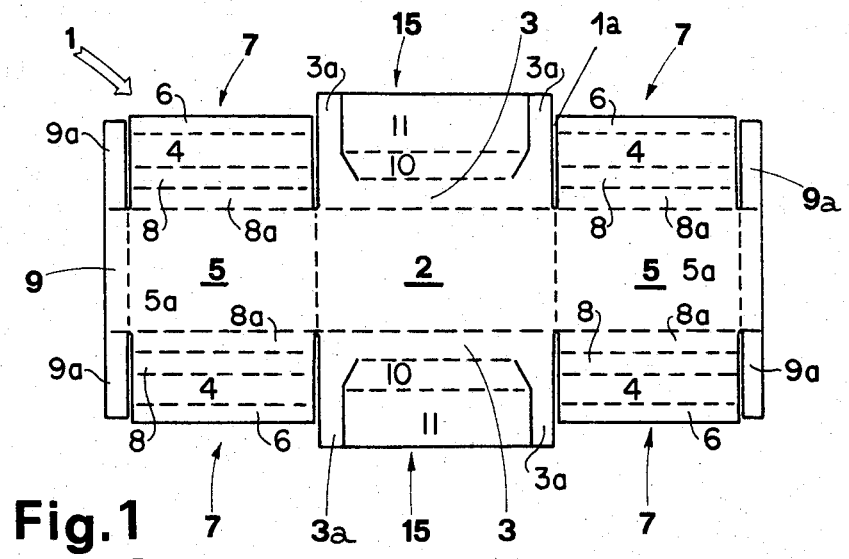
FIG. 1 shows, in a plan view, a blank.

With reference to the above listed figures, shown at 1 is a blank in which there are crosswise slits 1*a*, as well as longitudinal and transverse lines of articulation (shown with dashes) defining the bottom 2, the sides 3 and the ends 5, respectively, of the container. To each vertical edge of the ends 5 is articulated a limb 7 of a height corresponding to that of the ends themselves. Each limb is provided with vertical articulations that make possible the folding of this towards the inside face 5*a* of the corresponding end 5 in such a way as to define, in the order stated, a first tubular strengthening edge 8, a central area 4 destined to be glued, using known systems, to the inside face 5*a* and, lastly, a terminal zone 6 more about which will be said below; the strengthening edge 8 comprises a vertical strip 8*a* that is parallel to, and inside, the corresponding side 3.

To the upper transverse edge of each end 5 is articulated a corresponding element 9 that extends transversely past the end in two extremity sections 9*a*; a central section of the element 9 is made to rotate towards the inside of the container, resting on the upper extremities of the corresponding pair of limbs 7, while the said extremity sections 9*a* are turned downwards in close contact with corresponding vertical strips 8*a* in order to be glued, using known systems, to the said strips.

From an examination of the accompanying figures, it is obvious that each side 3 is in the form of a "U". The end pieces 3*a* of the said "U" are placed in close contact with the corresponding vertical strips 8*a* of the said tubular strengthening edges 8 (so as to be glued, in a known way, to the said strips) and are of a height such as to have the upper edges thereof positioned immediately beneath the lower edges of the corresponding, previously mentioned, extremity sections 9*a* of the elements 9.

Centrally articulated to each side 3, in the region of the upper edge, is an area I5 constituted by two consecutive parts, namely a first part 10 and a second part 11, that are articulated one to the other along a longitudinal jointing line. The said first part 10 is placed in close contact with the inside face of the corresponding side, while the second part 11 is placed, in the embodiments depicted in FIGS. 2 and 3, tightly up against the bottom 2 in order to be glued thereto, again in a known way.

Figure 2:
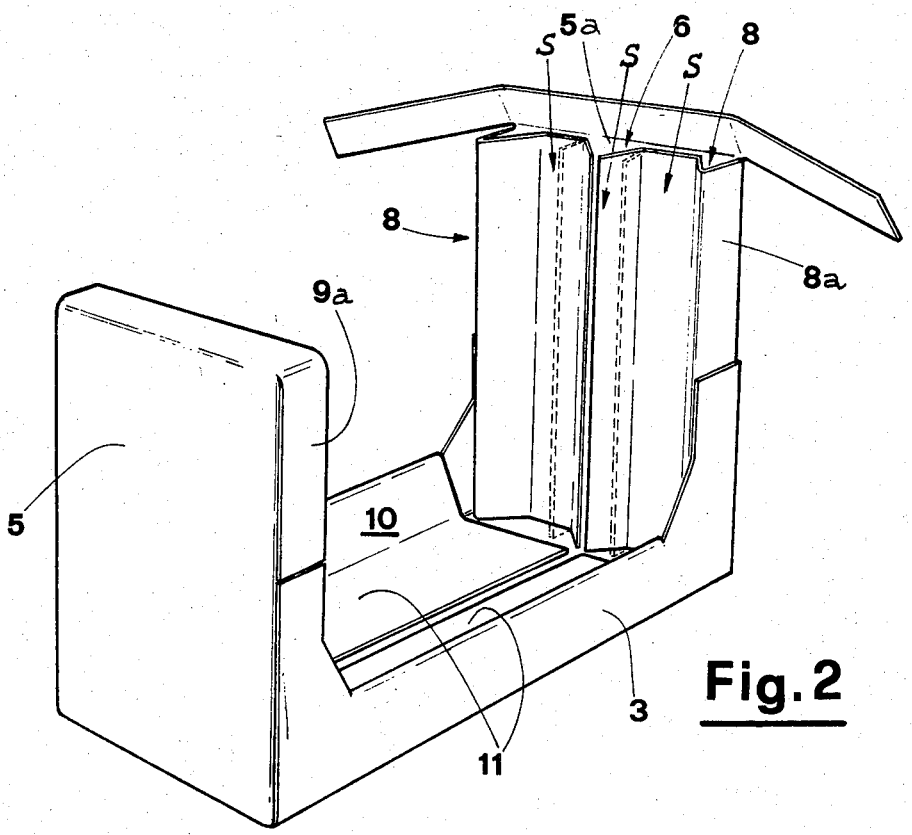
FIG. 2 shows, in a perspective view, a partially formed container for which the blank depicted in FIG. 1 has been used.

In the embodiment shown in FIG. 2, the terminal zones 6 of the limbs 7 are constituted by flat parts able to rotate with respect to the vertical edge of the adjacent areas 4. When the said zones 6 are arranged in opposite parallel positions (as shown with dashes in FIG. 2), they define, in the region of the ends, three housings S destined to receive the articles at the ends of the three rows of cylindrical articles placed in the container.

Figure 3:
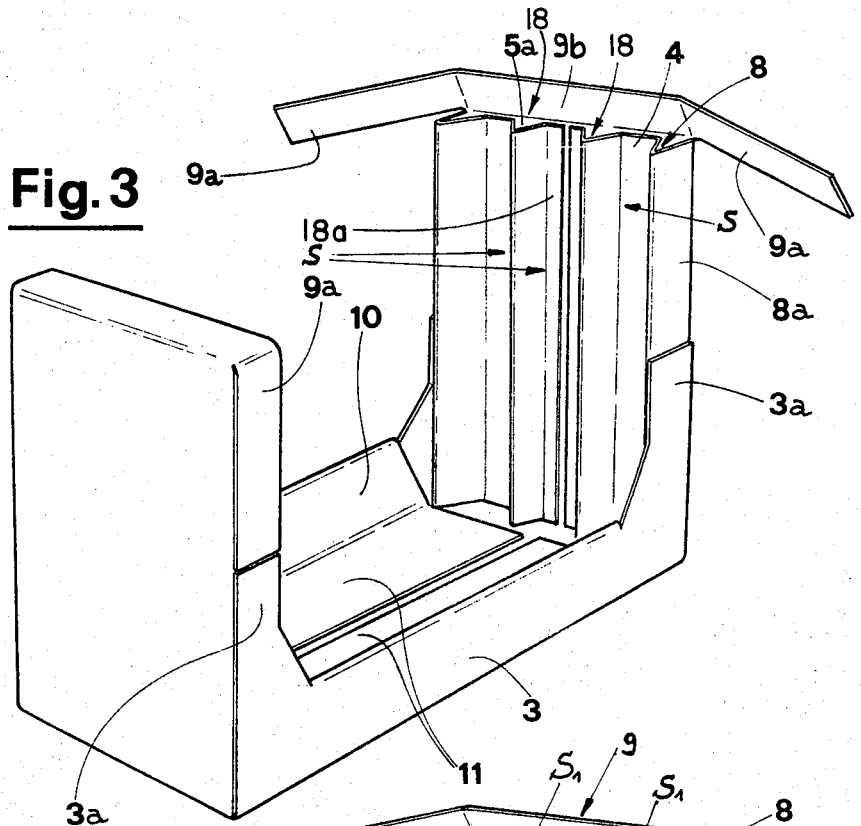
FIGS. 3 and 4 each show, in a perspective view, a partially formed container having variants with respect to the embodiment depicted in FIG. 2.

Each terminal zone 6 is, in the variant according to FIG. 3, folded so as to define a second tubular strengthening edge 18, as well as a final strip 18*a* destined to be glued, in a known way, to the inside face 5*a*. Here again, in the region of the ends, three housings S are defined, and these perform the same function as the three previously mentioned housings S.

Figure 4:
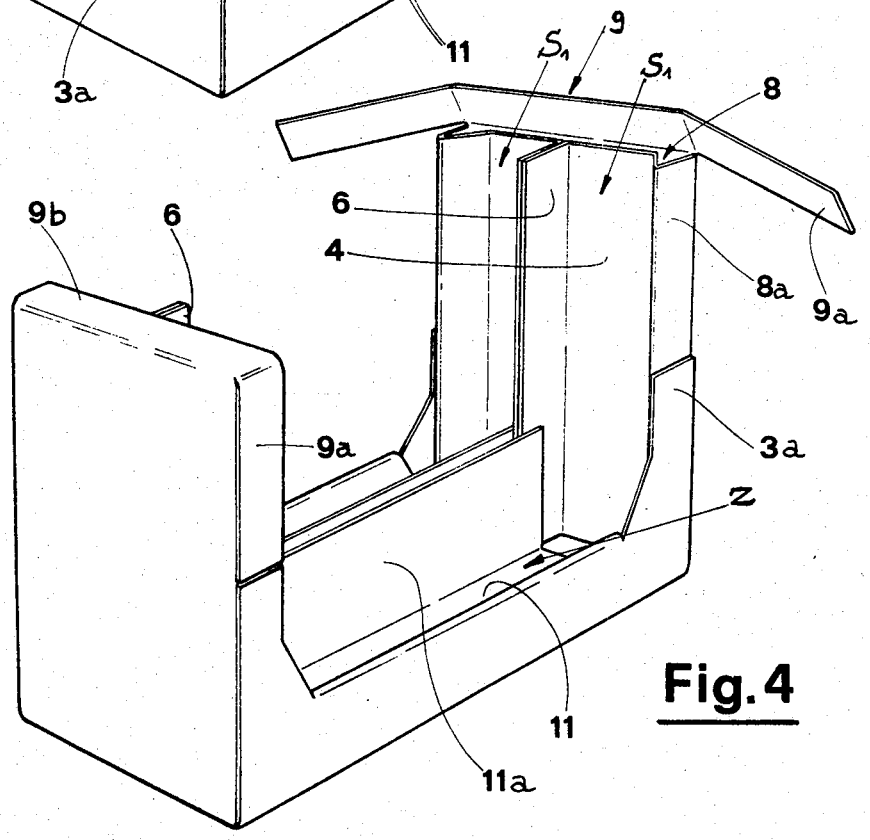

In the variant shown in FIG. 4, the terminal zones 6 in respect to the adjoining pair of limbs 7, are placed facing and partially inserted in the longitudinal track formed by the upward folded longitudinal edges 11*a* of the said second parts 11 of the areas 15. Created in the container according to FIG. 4 are two longitudinal zones Z (one divided from the other by the said edges 11*a*) that converge, through the extremities thereof, in corresponding housings $S_1$ destined to receive the cylindrical articles at the ends of two rows of articles placed in the container.

The formation of the container envisages, first of all, the limbs 7 being folded (with the gluing of the central areas 4 to the inside faces 5*a*), the sides 3 being turned upwards (with the gluing of the end pieces 3*a* to the vertical strips 8*a* of the edges 8), and the areas I5 being folded (with the gluing of the second parts 11 to the upper surface of the bottom 2); then the elements 9 being folded, turning downwards the extremity sections 9*a* (with the gluing of the latter to the vertical strips 8*a*). In the variant shown in FIG. 3 it is necessary, after having folded the limbs, to glue to the inside faces 5*a* also the final strips I8*a*.

The particular conformation of the container forming the subject of the invention has been devised in order to give the container considerable mechanical strength.

The said strength is achieved in consequence of the thickness of the sides 3 being doubled (due to the presence of the first parts 10), the thickness of the bottom being doubled (due to the presence of the second parts 11), and the particular resistance to flattening the ends 5 have (due, in the examples given in FIGS. 2 and 4, to the presence of the first strengthening edges 8, and in the example given in FIG. 3, to the presence of the second strengthening edges I8), as well as the thickness of the ends themselves being doubled in the region of the said central areas 4 and, lastly, on account of the fact that the sides 3 (in particular the end pieces 3*a*) are locked to the said ends, or more precisely, to the first strengthening edges 8.

It must also be stressed that the particular conformation of the limbs 7 enables them to have a dual function: in combination with the corresponding ends 5, in fact, the said limbs give the container considerable resistance to flattening and, furthermore, contribute to defining, along with the bottom and the elements 9, the said housings S and $S_1$.

The central section of the said elements defines the upper resting surface of the container, that is to say, the surface destined to receive an overhead row of containers. The resistance to flattening the said surface possesses stems directly from the fact that the central sections 9*b* of the elements are placed resting on the upper extremities of the limbs 7.

In the event of it being wished to close the container at the top, it would suffice for provision to be made of, for example, at least one element 9 with a corresponding central section 9*b* that extends longitudinally in such a way as to be able to rest on the limbs 7 of the opposite end.

Lastly, stress is laid on the fact that the "U" shaped sides 3 permit the articles placed in the container to be visible.

To conclude, the invention fulfils the object proposed; in particular, the container offers considerable resistance to flattening and, furthermore, the particular box shaped structure thereof renders the container highly resistant to torsional stress.

It is understood that any variants with respect to the above technical solution do not prejudice the framework of protection afforded to the invention as described above and claimed hereinafter; for example, the walls defining the first strengthening edge 8, and if wished the second strengthening edge I8, can mate one with other, and the number of the said edges, as also the number of housings S defined by the said edges, can be any.

What is claimed is:

1. Improved container for receiving various articles, in particular cylindrical articles, formed from a single flat blank having longitudinal and transverse dimensions with slits crosswise of the longitudinal dimension and longitudinal and transverse lines of articulation, said longitudinal and transverse lines folded to define a bottom, vertical sides and vertical ends of the container, each vertical edge of said ends having a vertical line of articulation folded to form a limb, of a height corresponding to that of said ends, said limb being folded towards an inside face of each end to define a first strengthening edge, a central area glued to said inside face of said end and a terminal zone, with said first strengthening edge comprising a vertical strip positioned parallel to and inside the corresponding side; an upper transverse edge of each end articulating a corresponding element, constituted by a central section, resting on upper extremities of the pair of limbs attached to said end, and two extremity sections, each turned downwardly in glued contact with the corresponding vertical strip of said strengthening edge; each side being provided with two end pieces placed in glued contact with the corresponding vertical strip of said strengthening edges; each side being centrally folded in the region of the upper edge to form an area constituted by a first part, placed in contact with the inside face of said side and a second part, articulated longitudinally to the first part, glued to said bottom.

2. The container according to claim 1, wherein the terminal zone of each limb comprises vertical articulations defining a second vertical strengthening edge and a strip glued to the inside face of the corresponding end.

3. The container according to claim 1, wherein both second parts in respect of the areas folded centrally to said sides have longitudinal edges thereof folded upwardly defining therebetween, a space receiving partially the terminal zones of said limbs, with the terminal zones in respect of a pair of adjacent limbs mating one with the other.

4. The container according to claim 1, wherein said first strengthening edges are of tubular conformation.

5. Container according to claim 2 wherein said second strengthening edges are of tubular conformation.

* * * * *